US010342321B1

(12) United States Patent
Le

(10) Patent No.: US 10,342,321 B1
(45) Date of Patent: Jul. 9, 2019

(54) SEGMENTED PORTABLE BED APPARATUS AND METHOD OF USE

(71) Applicant: Tu Van Anh Le, Cordova, TN (US)

(72) Inventor: Tu Van Anh Le, Cordova, TN (US)

( * ) Notice: Subject to any disclaimer, the term of this patent is extended or adjusted under 35 U.S.C. 154(b) by 230 days.

(21) Appl. No.: 15/417,711

(22) Filed: Jan. 27, 2017

Related U.S. Application Data

(60) Provisional application No. 62/288,646, filed on Jan. 29, 2016.

(51) Int. Cl.

| | |
|---|---|
| ***A45F 4/06*** | (2006.01) |
| ***A47G 9/08*** | (2006.01) |
| ***A47G 9/10*** | (2006.01) |
| ***A47G 9/06*** | (2006.01) |

(52) U.S. Cl.
CPC ..... *A45F 4/06* (2013.01); *A47G 9/062* (2013.01); *A47G 9/08* (2013.01); *A47G 9/1027* (2013.01)

(58) Field of Classification Search
CPC ..... A45F 4/00; A45F 4/06
USPC ..... 5/417–420
See application file for complete search history.

(56) References Cited

U.S. PATENT DOCUMENTS

| | | | | |
|---|---|---|---|---|
| 4,575,884 | A | 3/1986 | Jamerson et al. | |
| 4,791,687 | A | 12/1988 | Iwase | |
| 4,915,662 | A * | 4/1990 | Kent | B63B 59/02 441/127 |
| 5,066,001 | A * | 11/1991 | Wilkinson | A63B 6/00 482/52 |
| 5,458,146 | A * | 10/1995 | Gregg | E04H 15/001 135/117 |
| 5,953,779 | A | 9/1999 | Schwartz | |
| 6,401,282 | B1 | 6/2002 | Shum | |
| 7,225,489 | B1 | 6/2007 | Frickey et al. | |
| 2014/0101848 | A1 * | 4/2014 | Murphy | A47G 9/08 5/420 |
| 2016/0143451 | A1 | 5/2016 | Le | |

* cited by examiner

*Primary Examiner* — Fredrick C Conley
(74) *Attorney, Agent, or Firm* — Susan B. Fentress; Veritay Group IP

(57) ABSTRACT

This inventive subject matter includes: a segmented portable bed apparatus made of: a first container connected to a segmented sleeping pad and a second container configured to accommodate a sleeping bag, an inflatable pillow, and a dome insect net. In one embodiment, the segmented portable bed apparatus is made of a first container having a segmented pad connected to the first container. The segmented pad is made of a bottom layer and a top layer, wherein the bottom layer is formed of alternating flat and raised pads, and wherein the top layer is formed of alternating flat and raised pads. The segmented portable bed apparatus has a folded configuration and unfolded configuration. The segmented portable bed apparatus, when in the unfolded configuration, the bottom layer and the top layer can be joined together to form a linear segmented pad.

8 Claims, 6 Drawing Sheets

SEGMENTED PORTABLE BED APPARATUS AND METHOD OF USE

CROSS REFERENCE TO RELATED APPLICATIONS

This application claim the benefit of provisional patent application U.S. Ser. No. 62/288,646 filed Jan. 29, 2016 (hereby incorporated by reference).

FIELD OF THE INVENTION

The subject matter of this invention generally relates to the field of, a portable bed and more particularly, to a sleeping bed apparatus and a method of use of the segmented portable bed apparatus.

BACKGROUND OF THE INVENTION

The invention relates to an improved portable foam/polyester fiber bed. Portable foam/polyester fiber pads have been used with sleeping bags and other applications such as play pens and for exercise mats, such in yoga. Many beds are uncomfortable or difficult to carry. Jamerson et al U.S. Pat. No. 4,575,884 discloses a foam rubber sleeping bed and a related sheet to protect the bed secured with snaps. Schwartz, U.S. Pat. No. 5,953,779 disclose a mattress assembly made of various blocks that when assembled forms a "stack of foam" mattress. While these units may be suited for the problem they address, they would not be suited for the present invention as heretofore described.

SUMMARY OF THE INVENTION

This inventive subject matter includes: a segmented portable bed apparatus made of: a first container connected to a segmented sleeping pad and a second container configured to accommodate a sleeping bag, an inflatable pillow, and a dome insect net. In one embodiment, the segmented portable bed apparatus is made of a first container having a segmented pad connected to the first container. The segmented pad is made of a bottom layer and a top layer, wherein the bottom layer is formed of alternating flat and raised pads, and wherein the top layer is formed of alternating flat and raised pads. The segmented portable bed apparatus has a folded configuration and unfolded configuration. The segmented portable bed apparatus, when in the unfolded configuration, the bottom layer and the top layer can be joined together to form a linear segmented pad.

The segmented portable bed apparatus in one embodiments has: a plurality of side panels, an openable lid, a base section and a top section; a plurality of closure elements positioned in a plurality of joints between the plurality of side panels, the openable lid, and the base section and the top section are configured to form a container in the folded configuration. The container can be collapsed to contact the base section and expanded to form a space for storage of the segmented pad in folded position. A segmented pad is attached to the base section. The segmented pad is made of a bottom layer and a top layer, wherein the bottom layer is formed of alternating flat and raised pads extending from the base and the top layer, and wherein the top layer is formed of alternating flat and raised pads, when in the unfolded configuration, the bottom layer and the top layer are joined to form a linear segmented pad.

This invention, in another embodiment, provides a segmented portable bed apparatus made of: a top section with a plurality of top raised bedding elements alternating with a plurality of top spacers; a base section with a plurality of base raised bedding elements alternating with a plurality of base spacers; a connector configured to connect one of the plurality of top spacers with one of the plurality of base spacers, wherein one of the plurality of top raised bedding elements is configured to contact one of plurality of base spacers and one of base section with a plurality of base raised bedding elements is configured to contact one of plurality of top spacers to form a segmented flat pad. The segmented flat pad is configured to be folded into a stacked arrangement for storage or transportation.

This invention, in another embodiment, includes a method to provide portable bedding, wherein a portion of a portable bed apparatus is a first container, a second container, a segmented pad, a sleeping bag with an inflatable pillow, and a dome formed to hold insect resistant netting. The process steps include: opening a first container with a plurality of panels. The first container is collapsed by placing the plurality of panels flush with a surface to form a linear first container; and extending a segmented pad made of a bottom layer and then extending a top layer, wherein the bottom layer is formed of alternating flat and raised pads extending from the base and wherein the top layer is formed of alternating flat and raised pads extending from the base, and combining the bottom layer and the top layer to form a linear segmented pad and securing the bottom layer to the top layer. The first container is collapsed by pushing in two short opposite sides to contact the base section of the first container. A second container is unzipped to unfold and/or roll out the sleeping bag along the linear segmented pad. The inflatable pillow is placed on the linear segmented pad. Finally, a flexible dome frame is erected to create a support for an insect resistant net. The procedures conducted in reverse to fold the contents for transportation or storage.

DETAILED DESCRIPTION OF THE INVENTION

The present invention may be understood more readily by reference to the following detailed description of the invention. It is to be understood that this invention is not limited to the specific devices, methods, conditions or parameters described herein, and that the terminology used herein is for describing embodiments by way of example only and is not intended to be limiting of the claimed invention. Also, as used in the specification including the appended claims, the singular forms "a," "an," and "the" include the plural, and reference to a numerical value includes at least that value, unless the context clearly dictates otherwise. Ranges may be expressed herein as from "about" or "approximately" one value and/or to "about" or "approximately" another value.

Figure 1:
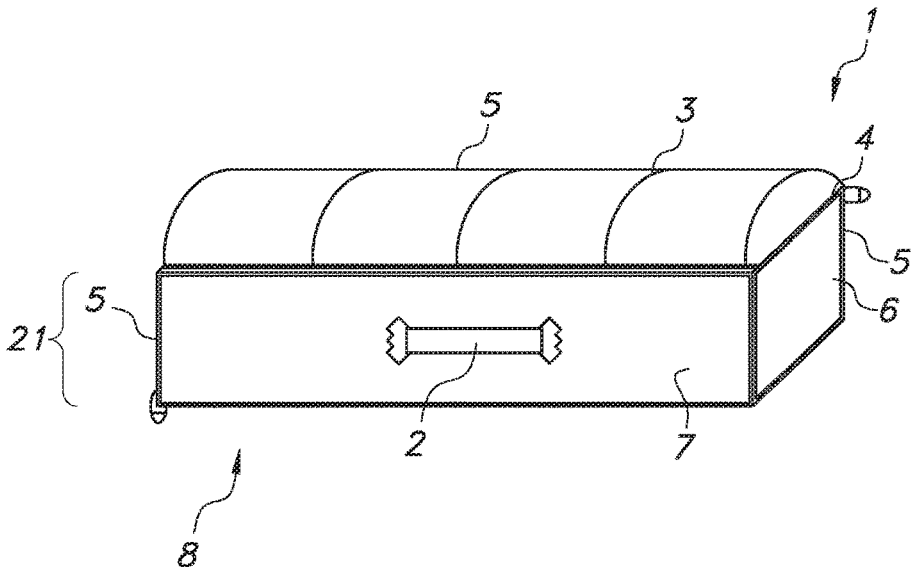
FIG. 1 shows a schematic view of a segmented portable bed apparatus in the closed position.
Figure 2:
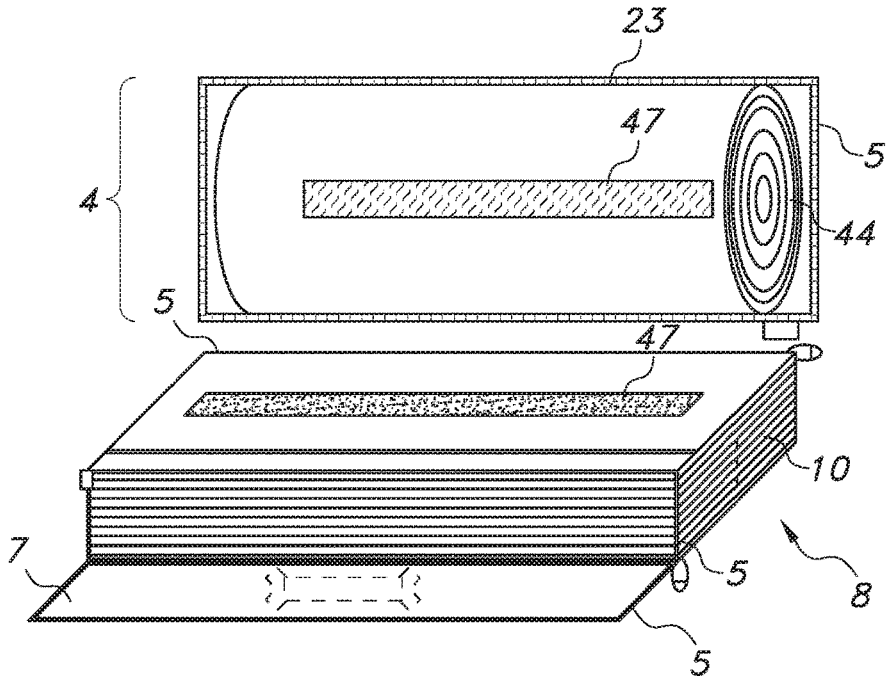
FIG. 2 shows a schematic view of an open apparatus with the segmented pad in the stacked configuration and an attached rolled sleeping bag.

Now referring to FIGS. 1-2, the segmented portable bed apparatus 1, is shown in the folded configuration for transportation or storage. In the folded configuration, the segmented portable bed apparatus 1 is generally rectangularly shaped, with an attachment handle or strap 2. The segmented portable bed apparatus 1, in the folded configuration, as shown in FIG. 1, forms a generally rectangular shape first container 21. The first container 21 is made of a plurality of side panels 6, an openable lid 7, and a base section 8 and a top section 4. A plurality of closure elements such as zippers are positioned in a plurality of joints 5 between the plurality of side panels 6, the openable lid 7, and the base section 8 and the top section 4. The exterior of the segmented portable bed apparatus 1 is made of waterproofed polyester fabric or plastic material that can form a container of sufficient rigidity to retain a segmented pad 10 within the first container 21. The top section 4 of the segmented portable bed apparatus 1, in one exemplary embodiment, forms the base of a second container 23. The second container 23 is configured to hold a sleeping bag 44, pillow (not shown), adjustable poles (not shown) and netting (not shown). The top section 4, in one exemplary embodiment, can be detached from the first container 21 and can be connected by adhesive or fastener strips 47.

Now referring to FIG. 2, the segmented portable bed apparatus 1 is opened. The segmented portable bed apparatus 1, is configured to be in the open position, when a plurality of closable elements in a plurality of joints 5, are not in contact with each other. The segmented portable bed apparatus 1 is made of a first container 21 and a second container 23. The first container 21 is configured to contain a segmented pad 10. The second container 23 is configured to retain a rolled or folded sleeping bag 44. The segmented pad 10 is stacked to fit within the first container 21 of the segmented portable bed apparatus 1, in the closed position. The segmented pad 10 is made of foam/polyester fiberfill, waterproofed polyester fabric or plastic material.

The segmented pad 10 forms a stack for storage when the pad of the top layer 15 and bottom layer 11 are stacked parallel or over each other. To stack up parallel, fold linear each pad of the top layer 15 first until the last pad, to form a first stack, then fold linear each pad of bottom layer 11 to form a second stack in a parallel position with the first stack. To stack up over each other, lift up the stack of bottom layer 11 and place over the stack of the top layer 15.

The top section 4 the segmented portable bed apparatus 1, is disconnect from the plurality of side panels 6 of the segmented portable bed apparatus 1. The closure elements, such as zippers that are positioned in a plurality of joints 5 between the plurality of side panels 6 are opened to allow the plurality of side panels 6 and the openable lid 7 of the first container 21 to contact a supporting surface such, as the ground or floor.

Figure 3A:
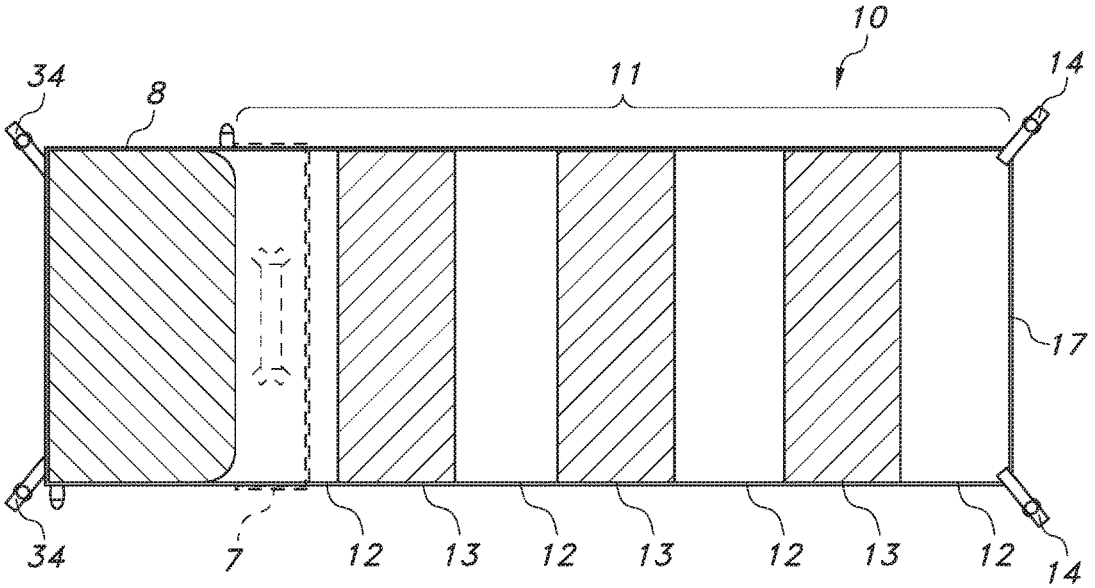
FIG. 3A shows a schematic view of the bottom layer of the segmented pad in the unfolded configuration.
Figure 4:
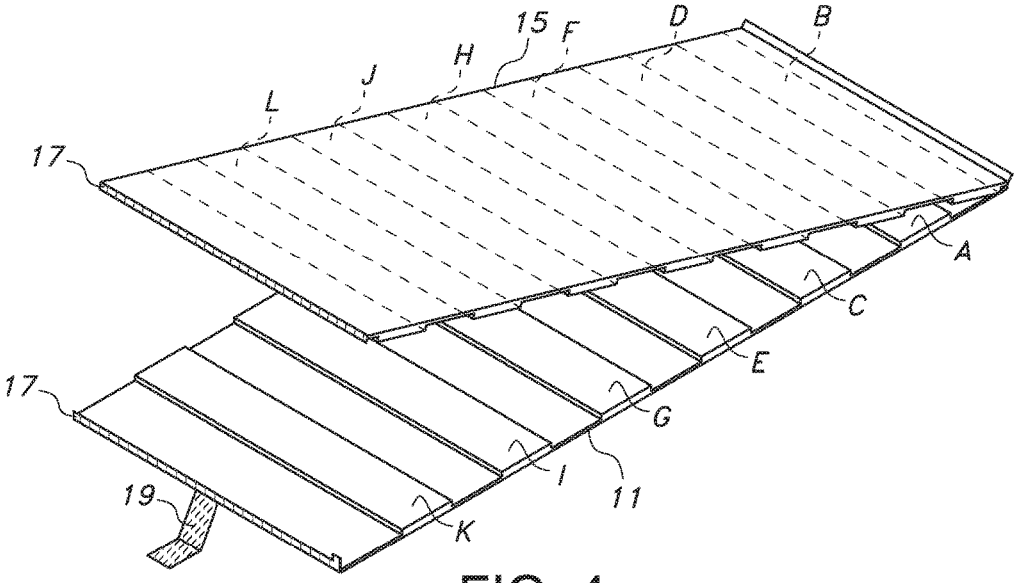
FIG. 4 shows a schematic view of the top and bottom portions of the segmented pad.

Now referring to FIGS. 3A, 38 and 4, a schematic view of the bottom layer 11 and top layer 15 of a segmented portable bed apparatus 1 in the unfolded configuration is shown. FIG. 3A shows a segmented pad 10 with the bottom layer 11 extended. In one exemplary embodiment, the bottom layer 11 is connect to the base 8 of the first container 21. The bottom layer 11 is formed of alternating flat 12 and raised pads 13 extending from the base 8 of the first container 21.

As shown in FIG. 4, the top layer 15 is formed of alternating flat 12 and raised pads 13. Each of the alternating flat 12 and raised pads 13 are shown as A, B, C, D, E, F, G, H, I, J, K, AND L. The alternating flat 12 and raised pads 13 are made of a closed-cell foam (such as a thermoplastic elastomer, including, TPE, EVA), polyester fiberfill or a similar material. As the top layer 15 is joined with the bottom layer 11, a flat smooth surface is formed, which is the segmented pad 10 top surface 16. The top layer 15 is joined with the bottom layer 11 at connector 17 such as, a zipper of hook and loop. In one embodiment, the raised pads 13 are indented about an inch from the edge of the segmented pad 10 to facilitate stacking of the pad.

Figure 3B:
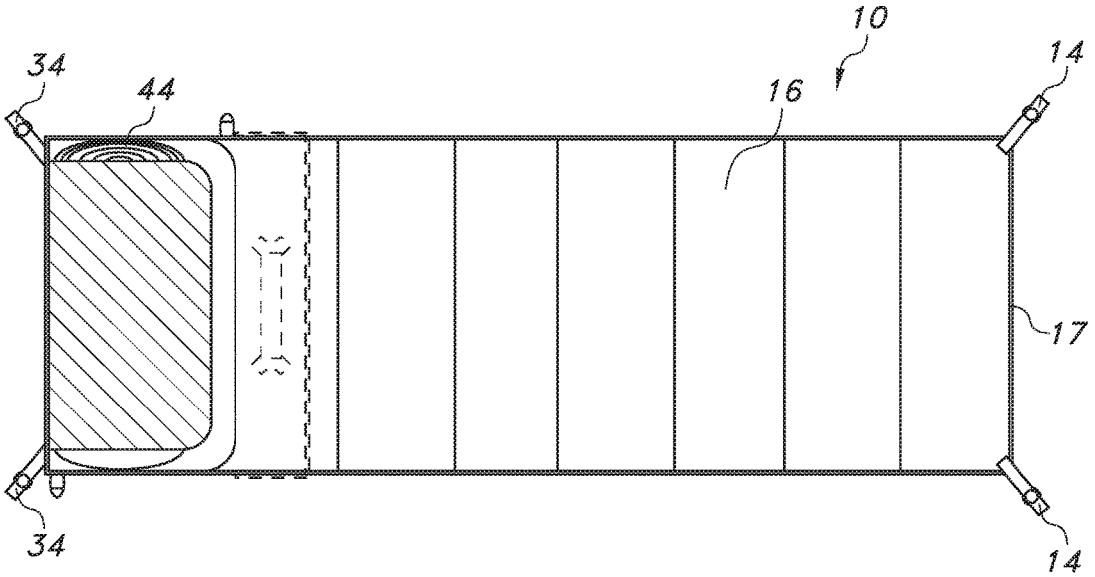
FIG. 3B shows a schematic view of a linear segmented pad in the unfolded configuration and unzipped second container with an attached sleeping bag.

Now referring to FIG. 3B, the segmented pad 10 is shown in the assembled position with the alternating flat 12 and raised pads 13 of the top and bottom section coming together to form a flat sleeping pad having a top surface 16.

Figure 5A:
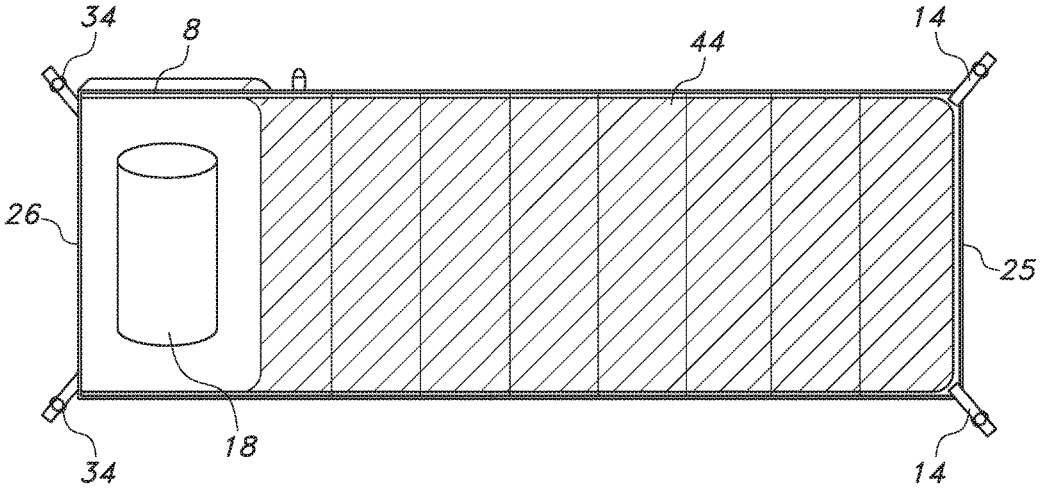
FIG. 5A shows a schematic view of assembled segmented portable bed apparatus with first container in collapsed position.

Now referring to FIG. 5A, a segmented portable bed apparatus 1 is shown with the segmented pad 10 with an unzip second container 23 to show a sleeping bag 44 unrolled and placed on top surface 16 of the segmented pad 10. A pillow 18 is placed on the base 8 of the segmented portable bed apparatus 1. The segmented pad 10 is shown in the final assembled position with a closure tab 19. In this flat position, the segmented pad 10 provides a cushion for sleep or exercise.

Figure 5B:
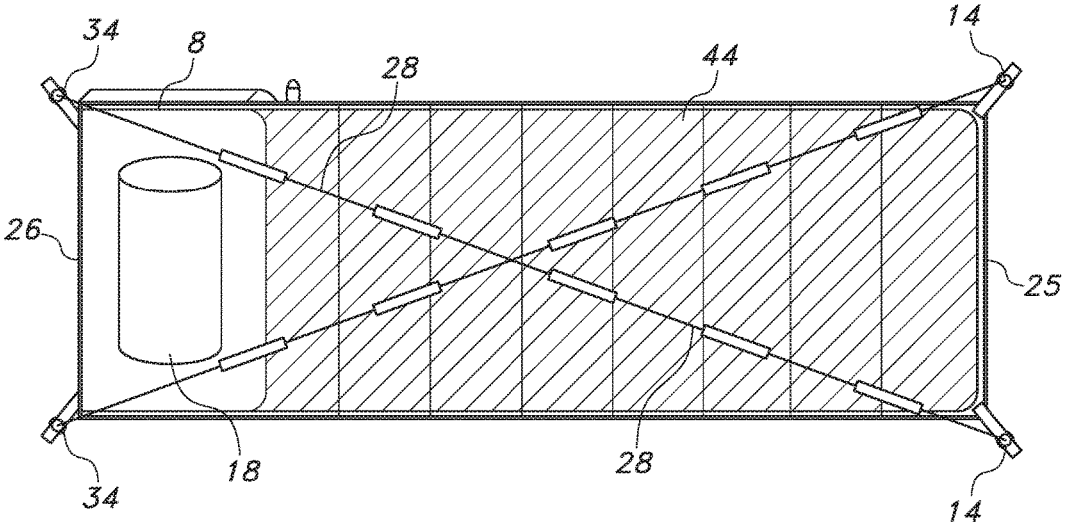
FIG. 5B shows a schematic view of assembled segmented portable bed apparatus with first container in collapsed position and with a domed section configured to support an insect resistant net.

Now referring to FIG. 5B, a first plurality of connectors 14 are attached to the segmented pad 10 at a first end 25 and a second plurality of connectors 34 attached to a second end 26. A domed net can be attached to the segmented flat pad 10 by attachment to the first plurality of connectors 14 and the second plurality of connectors 34. In exemplary example the second plurality of connectors 34 are attached to base 8. The first plurality of connectors 14 and the second plurality of connectors 34 connect to flexible rods 28 configured to form a dome above the segmented pad 10 with a sleeping bag 44 unrolled and placed on top surface 16 of the segmented pad 10. A light resistant screen or insect resistant net can be secured to the flexible rods 28 for privacy or protection from insects.

Figure 6:
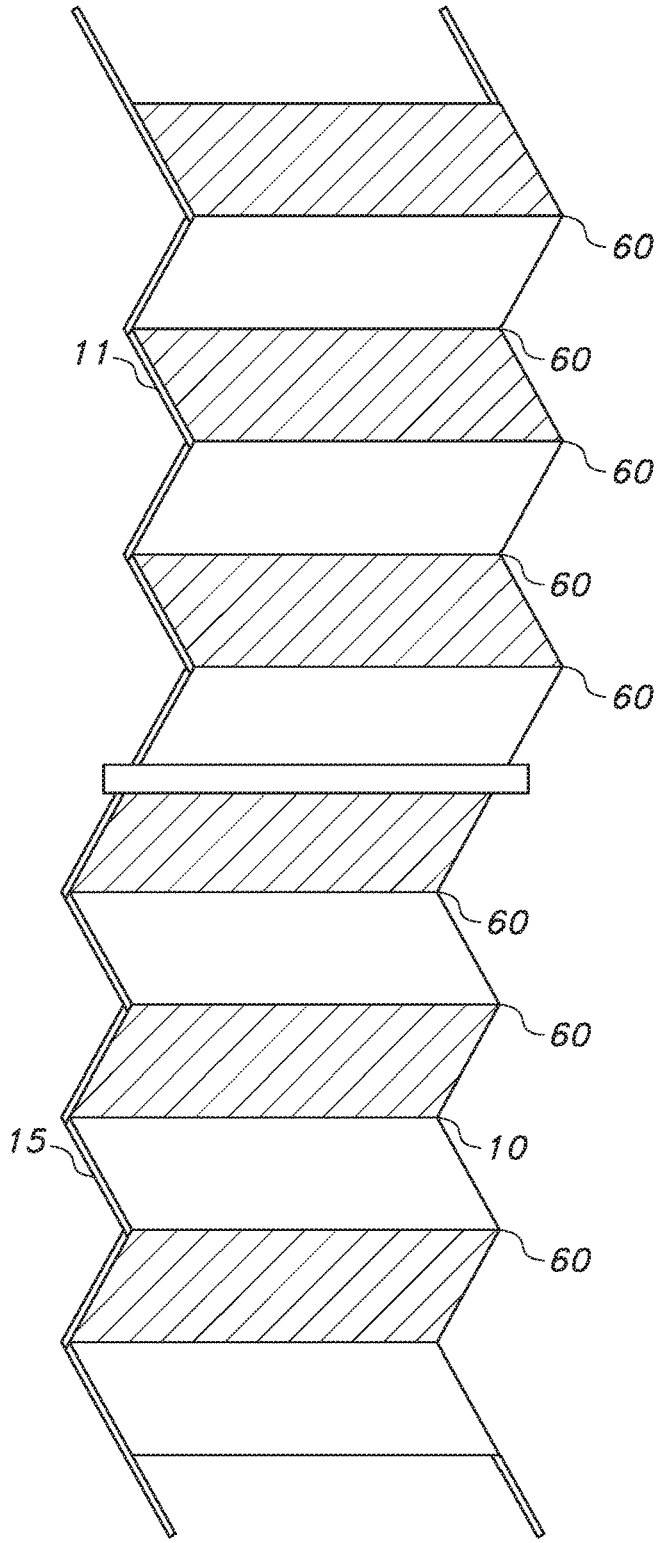
FIG. 6 shows a schematic view of another embodiment of the top and bottom layer of the segmented pad of a segmented portable pad apparatus in the folding process.

Now referring to FIG. 6, the top section 15 and bottom section 11 are configured to articulate through a plurality of segmented joints 60 between the alternating flat 12 and raised pads 13.

Figure 7A:
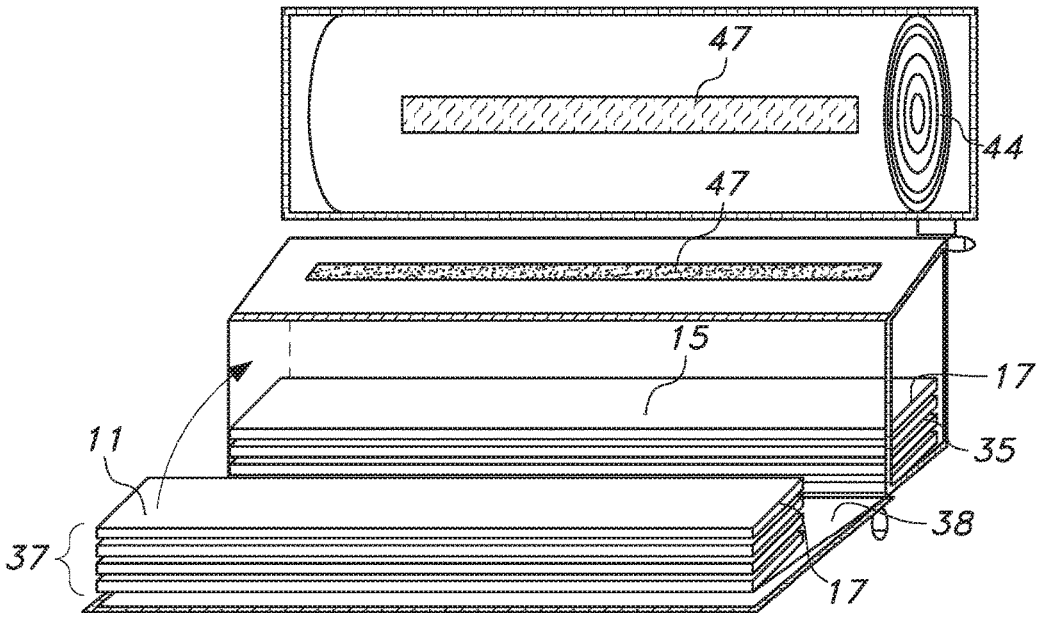
FIG. 7A shows a schematic view of another embodiment of a segmented portable bed apparatus in the process of folding the segmented pad in the stacked configuration.
Figure 7B:
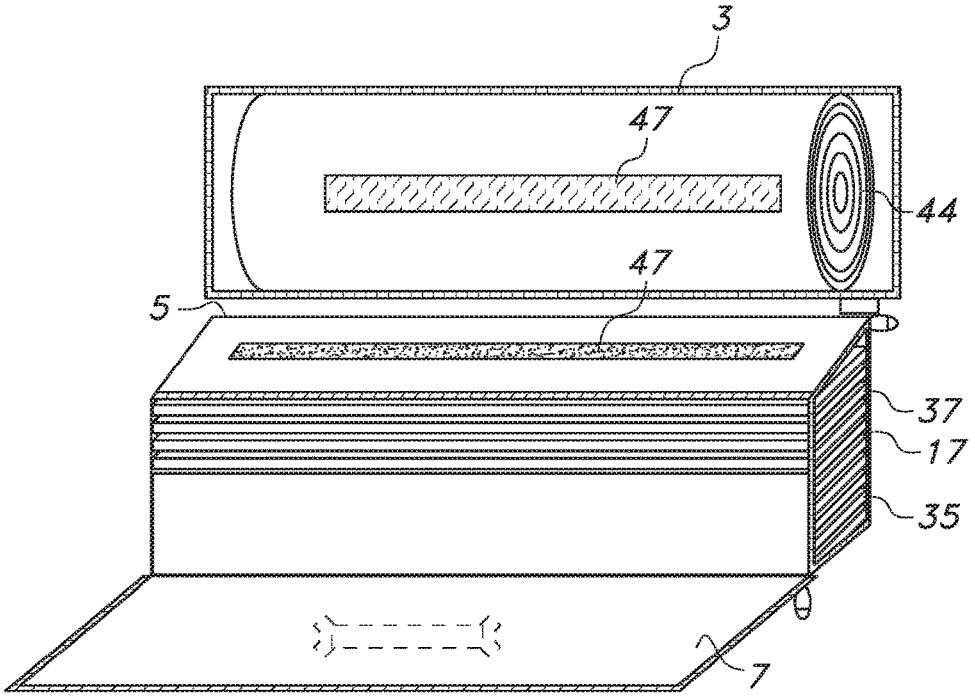
FIG. 7B shows a schematic view of another embodiment of a segmented portable bed apparatus showing the segmented pad in the stacked configuration.

Now referring to FIGS. 7A and 7B, show a schematic view of another embodiment of the segmented portable bed apparatus 1 in the folding process and the final folded configuration. In this embodiment, a linear array of the top section 15 form a generally rectangular top assembly 35. A linear array of the bottom section 11 form a generally rectangular bottom assembly 37. The generally rectangular top assembly 35 and the rectangular bottom assembly 37 are connected by spacer 38. The spacer 38 is of sufficient length to allow the generally rectangular top assembly 35 and the rectangular bottom assembly 37 to articulate to form a segmented portable bed apparatus 1. The rectangular bottom assembly 37 are connected by spacer 38 is placed on top of the generally rectangular top assembly 35 to form the stacked configuration shown in FIG. 7B.

The segmented portable bed apparatus 1 can be stored in the first container 21 made of a plurality of side panels 6, a lid 7, and base section 8. In the closed position, the segmented portable bed apparatus 1 is ready for transportation or storage.

Now referring to FIGS. 1-7B, the segmented portable bed apparatus 1 is used by: opening the lid 7 of the first container 21 with a plurality of panels 6, placing the plurality of panels 6 flush with a surface (the surface can be the ground, floor, or tent floor) to form a linear container; and extending the segmented pad 10 made of a bottom layer 11 and a top layer 15, wherein the bottom layer 11 is formed of alternating flat and raised pads extending from the base 8 and wherein the top layer 15 is formed of alternating flat and raised pads, and combining the bottom layer 11 and the top layer 15 to form a linear segmented pad 10. The first container is collapsed by pushing in two short opposite sides to contact the base section of the first container Additionally, the step of detaching a sleeping bag 44 from the second container 23 and positioning the sleeping bag 44 on the linear segmented pad 10 is provided.

A domed screen is positioned to cover the flexible rods 28 of the segmented portable bed apparatus 1. In one exemplary embodiment, a first portion of domed screen is attached to the flexible rods 28 of to the linear segmented pad 10 of the segmented portable bed apparatus 1 at connector 14 and a second portion of a domed screen is attached to the flexible rods 28 connected at connector 34. In further steps, other bedding elements, such as, a pillow 18 or a blanket are retrieved from the second container 23 and placed on the segmented portable bed apparatus 1 in the unfolded configuration.

The process to disassemble segmented portable bed apparatus 1 include the steps of: remove the flexible rods 28 configured to form a dome, fold or roll up the sleeping bag 44, deflate the pillow 18 and place in the second container 23 and the secured with a zipper. Separate the top layer 15 and the bottom layer 11 of segmented pad 10 and start folding top layer 15 and the bottom layer 11 to form a stack. The first container 21 can be lift up/expanded to form a room to store stack-up sleeping pad 10. The top layer 15 is stacked first, and then lifted to the first container 21 to store the first stack 37, then bottom layer 11 is stacked to form the second stack 35 and then the second stack 35 is lifted to the first container 21 to store on top of the first stack 37. The lid 7 of first container 21 is closed and the first container 21 and second container 23 are secured together for transportation or storage While the invention has been described regarding preferred and example embodiments, it will be understood by those skilled in the art that a variety of modifications, additions and deletions are within the scope of the invention, as defined by the following claims.

The invention claimed is:

1. A segmented portable bed apparatus comprising: a first container connected to a segmented sleeping pad, a second container configured to accommodate a sleeping bag, an inflatable pillow, and a plurality of flexible rods configured to form a dome, wherein the segmented sleeping pad is comprised of:

a top section with a plurality of top raised bedding elements alternating with a plurality of top spacers;

a base section with a plurality of base raised bedding elements alternating with a plurality of base spacers;

a connector to connect one of the plurality of top spacers with one of the plurality of base spacers, wherein one of the plurality of top raised bedding elements is configured to contact one of plurality of base spacers and one of base section with a plurality of base raised bedding elements is configured to contact one of plurality of top spacers to form the segmented sleeping pad.

2. The segmented portable bed apparatus of claim 1 wherein the raised bedding elements are indented from the edge of the segmented pad.

3. A method to provide a segmented portable bed apparatus, wherein a portion of the portable bed apparatus includes: a first container, a second container and a segmented pad, the process steps comprising:

a. opening a first container configured to contain a plurality of stacked panels;

b. extending the plurality of stacked panels to form a segmented pad comprised of a bottom layer and a top layer, wherein the bottom layer is formed of alternating flat and raised pads extending from the base and the top layer is formed of alternating flat and raised pads extending from the base, and combining the bottom layer and the top layer;

securing the bottom layer and the top layer to form a linear segmented pad; and collapsing the first container by pushing in two short opposite sides of the first container to make the top section of the first container contact its bottom section.

4. The method of claim 3 further comprising the step of: removing a sleeping bag from the second container; and positioning the sleeping bag on the linear segmented pad.

5. The method of claim 3 further comprising the step of removing an inflatable pillow from the second container; and positioning the pillow on the linear segmented pad.

6. The method of claim 3 further comprising the step of connecting a plurality of flexible rods to a first plurality of connectors attached to the segmented pad at a first end and a second plurality of connectors attached to a second end, wherein the plurality of flexible rods form a dome.

7. The method of claim 6 further comprising the step of attaching an insect restraint screen to cover the dome.

8. The method of claim 6 further comprising the step of attaching a light resistant screen to cover the dome.

* * * * *